US010661958B1

(12) United States Patent
Peloquin

(10) Patent No.: US 10,661,958 B1
(45) Date of Patent: May 26, 2020

(54) MASK PRODUCT AND ASSOCIATED METHOD

(71) Applicant: Bruce C. Peloquin, Milford, MA (US)

(72) Inventor: Bruce C. Peloquin, Milford, MA (US)

(73) Assignee: Fourstar Group Inc., Taipei (TW)

( * ) Notice: Subject to any disclaimer, the term of this patent is extended or adjusted under 35 U.S.C. 154(b) by 385 days.

(21) Appl. No.: 15/435,463

(22) Filed: Feb. 17, 2017

(51) Int. Cl.

| | |
|---|---|
| ***B65D 73/00*** | (2006.01) |
| ***B65B 15/00*** | (2006.01) |
| ***B65D 75/56*** | (2006.01) |
| ***A63H 5/00*** | (2006.01) |

(52) U.S. Cl.
CPC ..... *B65D 73/005* (2013.01); *A63H 5/00* (2013.01); *B65B 15/00* (2013.01); *B65D 75/566* (2013.01)

(58) Field of Classification Search
CPC .... B65D 73/00; B65D 73/005; B65D 73/566; B65D 15/00; B65D 75/28; A63H 5/00; B65B 15/00
USPC ..... 206/471, 281, 292, 457, 458, 483, 486, 206/461, 779
See application file for complete search history.

(56) References Cited

U.S. PATENT DOCUMENTS

| | | | | | |
|---|---|---|---|---|---|
| 3,197,093 | A * | 7/1965 | Doran | A47F 7/06 | 223/66 |
| 3,750,869 | A * | 8/1973 | Kartiganer | A45D 44/14 | 206/756 |
| 4,485,921 | A * | 12/1984 | Geller | B65D 73/00 | 206/281 |
| 4,653,642 | A * | 3/1987 | Hakun | B65D 75/28 | 206/457 |
| 5,845,778 | A * | 12/1998 | Hickey, Jr. | B65D 75/36 | 206/459.5 |
| 2008/0139081 | A1* | 6/2008 | Lin | A63H 5/00 | 446/297 |

* cited by examiner

*Primary Examiner* — Steven A. Reynolds
*Assistant Examiner* — Javier A Pagan
(74) *Attorney, Agent, or Firm* — Salter & Michaelson

(57) ABSTRACT

A mask product includes a pliable fabric mask that can be hung for display purposes, and a two piece head structure that includes a front head structure and a rear head structure. The mask product has a packaging and shipping state in which the fabric mask is disposed over at least the front head structure, and the rear head structure is reversed in position and nested into the front head structure so as to minimize the footprint of the mask product, and a display state in which the front head structure engages with the rear head structure to form a completed full head structure, the pliable fabric mask being disposed over the full head structure.

29 Claims, 11 Drawing Sheets

MASK PRODUCT AND ASSOCIATED METHOD

FIELD OF THE INVENTION

The present invention relates in general to an improved mask product. More particularly, the invention relates to a method for the packaging and setup of the mask product. Even more particularly the present invention relates to an improved mask product that assumes a nested state for shipment and an assembled state for use.

BACKGROUND OF THE INVENTION

There presently exists mask products. However, these products, for final display purposes, require a full size head structure. This has been found to be a cumbersome arrangement particularly with respect to shipping multiple mask products.

Accordingly, it is an object of the present invention to provide an improved method for the packaging and setup or display of a mask product.

Another object of the present invention is to provide a mask product that may be considered as having a first display position in which front and rear head structures are nested for shipment and display, and a second position that may be considered for re-assembly and for the final display of the mask product.

Still another object of the present invention is to provide a mask product that, for the purpose of shipment, has a rear head structure nested with a front head structure and for the purpose of final display of the mask product, the head structures are assembled into a full head structure over which a pliable fabric mask is disposed.

SUMMARY OF THE INVENTION

To accomplish the foregoing and other objects, features and advantages of the present invention, a method of packaging and set-up of a mask product that is in the form of a fabric mask that is constructed and arranged, once assembled, for engagement over a two-piece head structure, the head structure is comprised of an open front head structure and an open rear head structure. For the purpose of initially shipping the mask product, disposing the fabric mask over at least the front head structure and nesting the rear head structure, in a reversed position, into the front head structure so as to minimize the square or cubic inch footprint of the mask product.

In accordance with other aspects of the present invention providing a mounting panel for the mask product, said mounting panel having a cutout having a contour matching that of the mask product and for receiving the nested front and rear head structures; providing each of the front and rear head structures with mating respective top and bottom tabs, and further including a pair of securing loops mounted on the mounting panel for holding the respective top and bottom tabs; providing interlocking surfaces on the respective top and bottom tabs so that the front and rear head structures are engaged with each other for packaging and shipping; wherein the set-up step includes engaging the front and rear structures in a full head position and disposing the open ended mask over the full head structure; and wherein the front and rear head structures have mating respective top tabs, and the set-up step further includes providing a hanging cord for hanging the mask product from an overhead surface.

In accordance with another version of the present invention there is provided a mask product that is comprised of a pliable fabric mask that can be hung for display purposes, and a two piece head structure that is comprised of a front head structure and a rear head structure, said mask product having a packaging and shipping state in which the fabric mask is disposed over at least the front head structure, and the rear head structure is reversed in position and nested into the front head structure so as to minimize the footprint of the mask product, and a display state in which the front head structure engages with the rear head structure to form a completed full head structure, the pliable fabric mask being disposed over the full head structure.

In accordance with still other aspects of the present invention providing a mounting panel for the mask product, said mounting panel having a cutout having a contour matching that of the mask product and for receiving the nested front and rear head structures; wherein each of the front and rear head structures has mating respective top and bottom tabs, and further including a pair of securing loops mounted on the mounting panel for holding the respective top and bottom tabs; wherein the respective top and bottom tabs each include interlocking surfaces so that the front and rear head structures are engaged with each other for packaging and shipping; wherein, in the display state the front and rear structures are engaged in a full head position and the pliable fabric mask is disposed over the full head structure; wherein the front and rear head structures have mating respective top tabs, and in the display state there is provided a hanging cord for hanging the mask product from an overhead surface; including a controller disposed within or adjacent to the full head structure and for controlling audio and visual effects associated with the mask product; and including at least one light disposed within the head structure and controlled from the controller.

In accordance with another version of the present invention there is provided a method of transitioning a mask product that includes an open front head structure, an open rear head structure and a pliable fabric mask, from a packaging and shipping state to a display state, comprising the steps of establishing, in the packaging and shipping state, a nested mask product in which the fabric mask is disposed over at least the front head structure and the rear head structure in a reversed position is nested into the front head structure so as to minimize the square inch footprint of the mask product, and in the display state, the front and rear head structures are assembled into a full head structure, and disposing the pliable fabric mask over the full head structure for the display of the mask product.

In accordance with still other aspects of the present invention providing a mounting panel for the mask product, said mounting panel having a cutout having a contour matching that of the mask product and for receiving the nested front and rear head structures; providing each of the front and rear head structures with mating respective top and bottom tabs, and further including a pair of securing loops mounted on the mounting panel for holding the respective top and bottom tabs; providing interlocking surfaces on the respective top and bottom tabs so that the front and rear head structures are engaged with each other for packaging and shipping; providing a controller disposed within or adjacent to the full head structure and for controlling audio and visual effects associated with the mask product and including at least one light disposed within the head structure and controlled from the controller; and wherein the front and rear head structures have mating respective top tabs, and the display step further includes providing a hanging cord for hanging the mask product from an overhead surface.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 1:
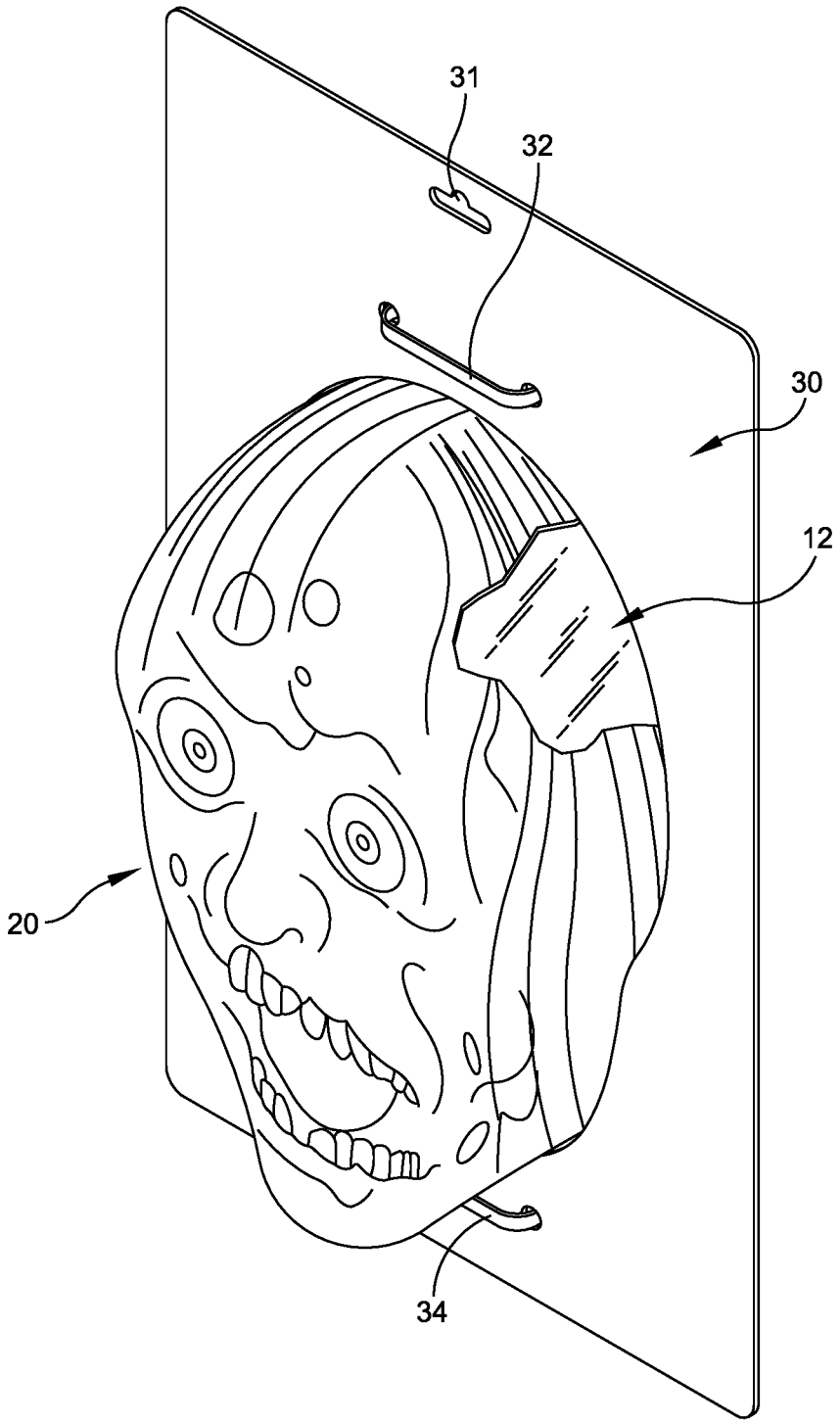
FIG. 1 is a front perspective view illustrating the mask product with the mask head structures nested in a first display state.
Figure 4:
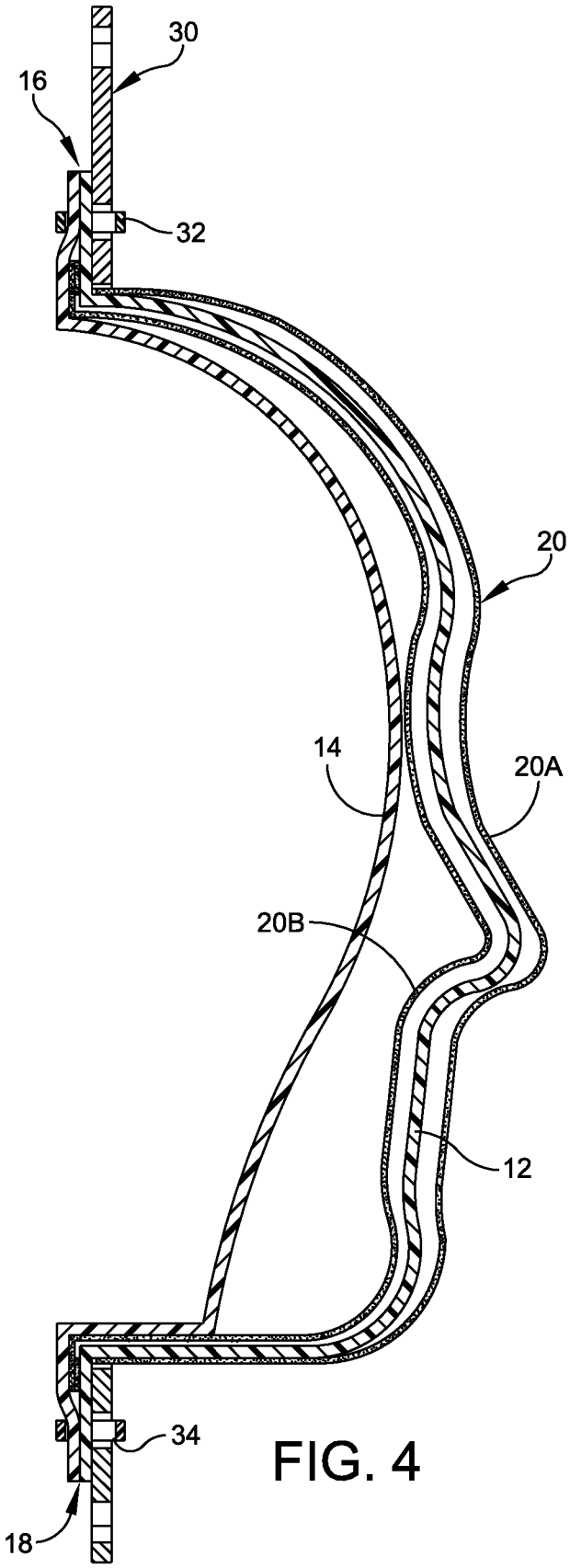
FIG. 4 is a cross-sectional view taken along line 4-4 of FIG. 3.
Figure 9:
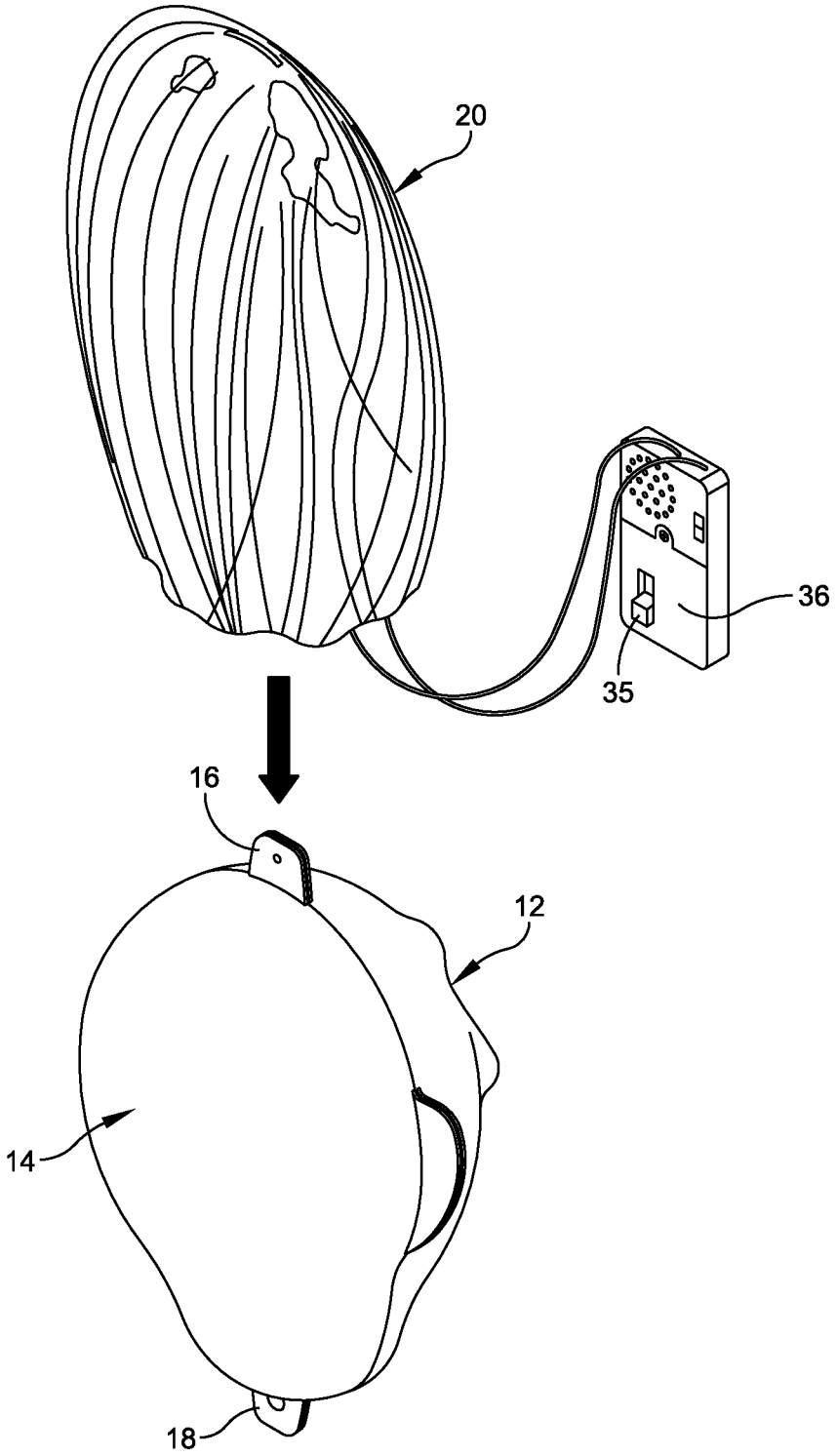
FIG. 9 is a perspective view illustrating the head structure in a finally completed state for receiving the mask.
Figure 10:
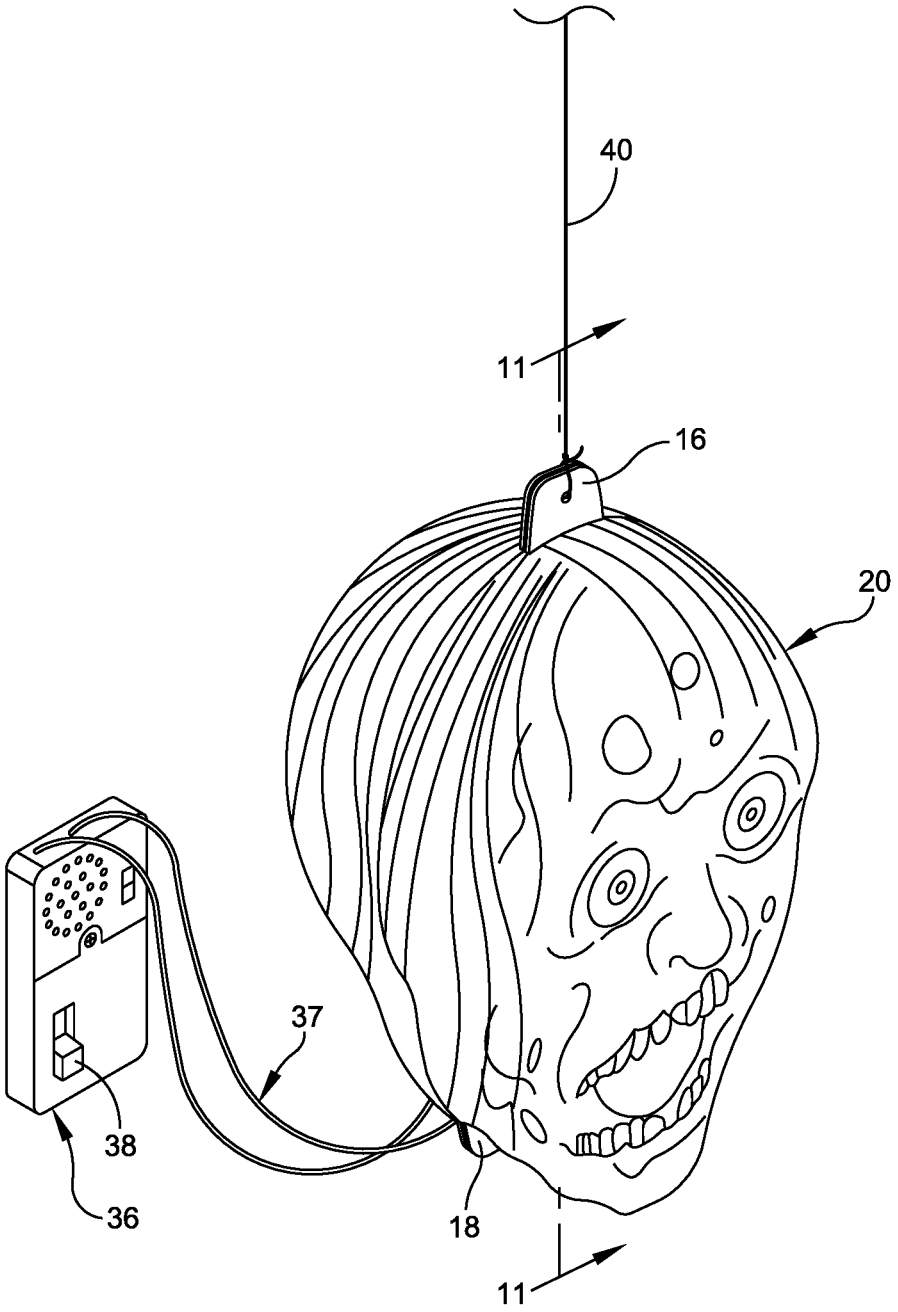
FIG. 10 illustrates the mask product in its final display position hung from overhead.
Figure 11:
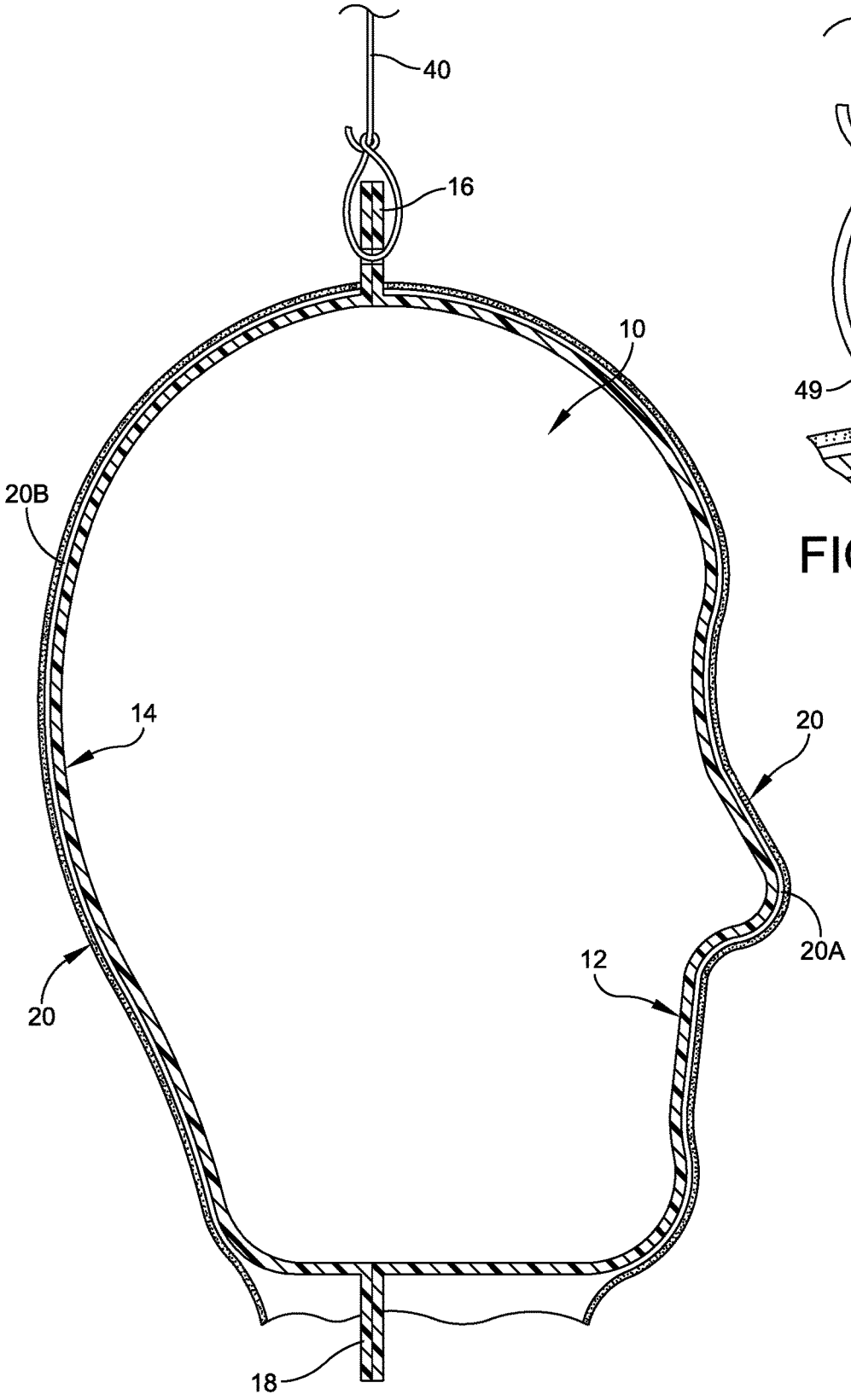
FIG. 11 is a cross-sectional view taken along line 11-11 of FIG. 10.

The mask product of the present invention may be considered as having a first display position where the mask product is displayed for sale. In this display position, the separate front and rear head structures are nested. This nesting is illustrated in the cross-sectional view of FIG. 4. In accordance with present invention and as illustrated in FIGS. 9-11, there is a final display position where the ultimate purchaser is able to assemble the final head structure for display purposes such as by being hung from an overhead position, as illustrated in FIG. 10. In the first display position where the mask product is displayed for initial sale as shown in FIG. 1, the mask itself covers the head structures facing front to show the consumer the appearance of the mask product and what the final assembled product looks like.

The mask product may be considered as comprised of a plastic two piece head structure 10 including a front head structure 12 and a rear head structure 14. The cross-sectional view of FIG. 11 shows these head structures in their final position for display and furthermore illustrates the mask 20 disposed over both the front head structure 12 and the rear head structure 14. Refer also to FIG. 10 showing the head structure and overlaid mask 20, along with the controller 36 for providing audio and visual effects. Although the mask is preferably formed of a pliable fabric mask product, in accordance with the present invention the mask may also be constructed in a plastic form; either pliable or firm in form.

Thus, the head structure is provided in two similar pieces 12, 14 that, when formed together, provide the full head structure 10 illustrated in FIG. 11. The nesting arrangement of the head structures 12 and 14 is illustrated in the cross-sectional view of FIG. 4. This initial nested position is illustrated in FIGS. 1-8 wherein the inner structure 14 is essentially reversed from the full head position shown in FIG. 11.

Figure 2:
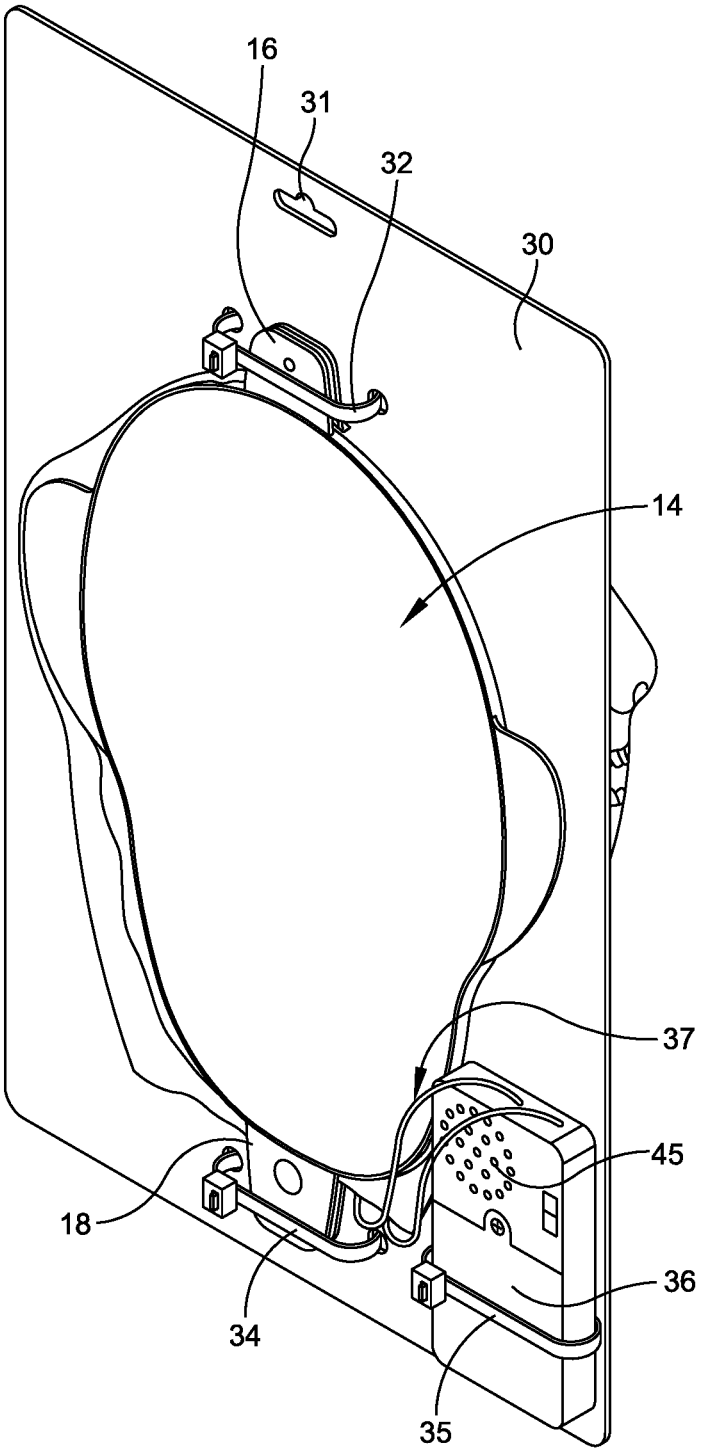
FIG. 2 is a rear perspective view of the mask product and associated mounting panel.
Figure 3:
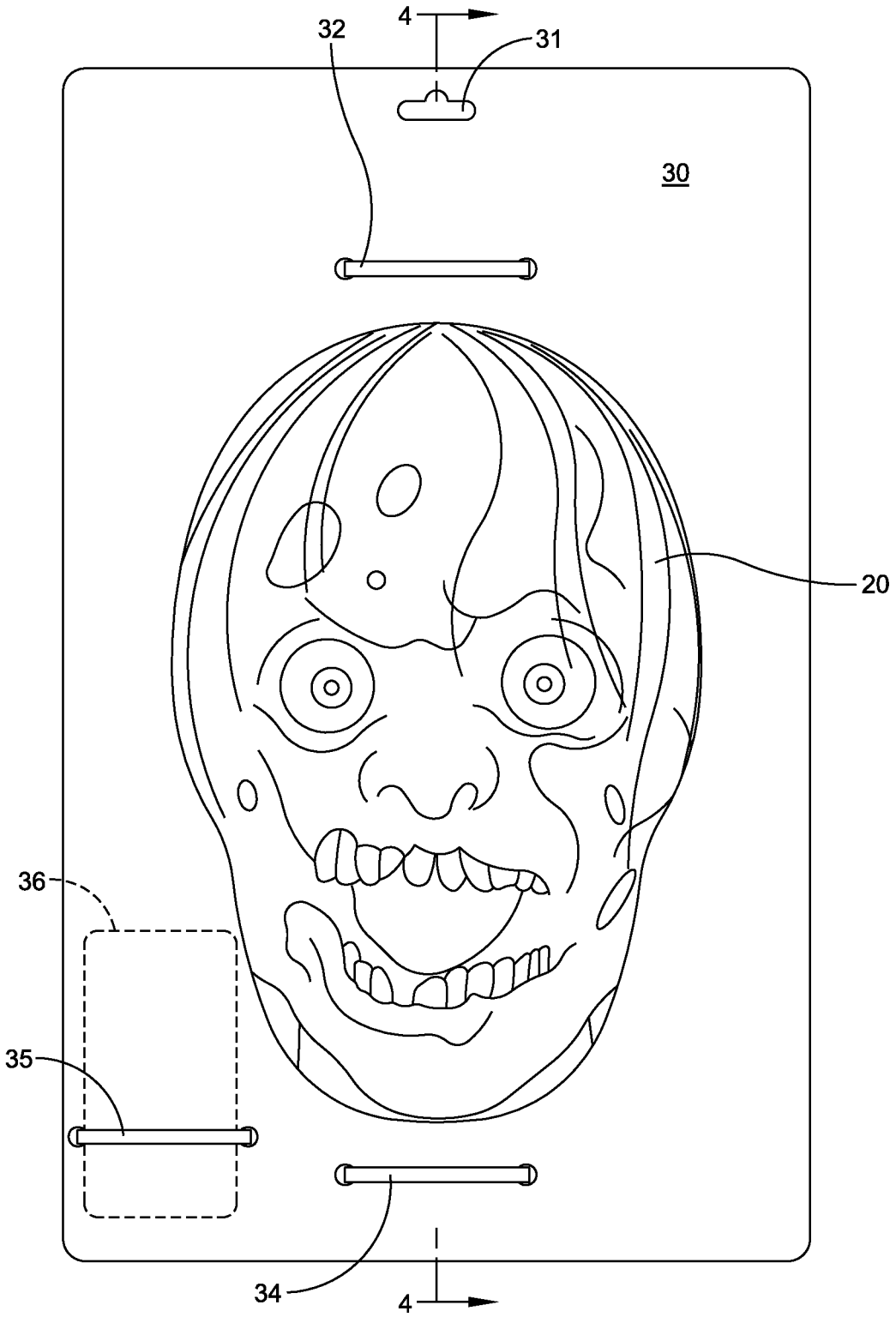
FIG. 3 is a front elevation view of the mask product illustrated in FIGS. 1 and 2.
Figure 6:
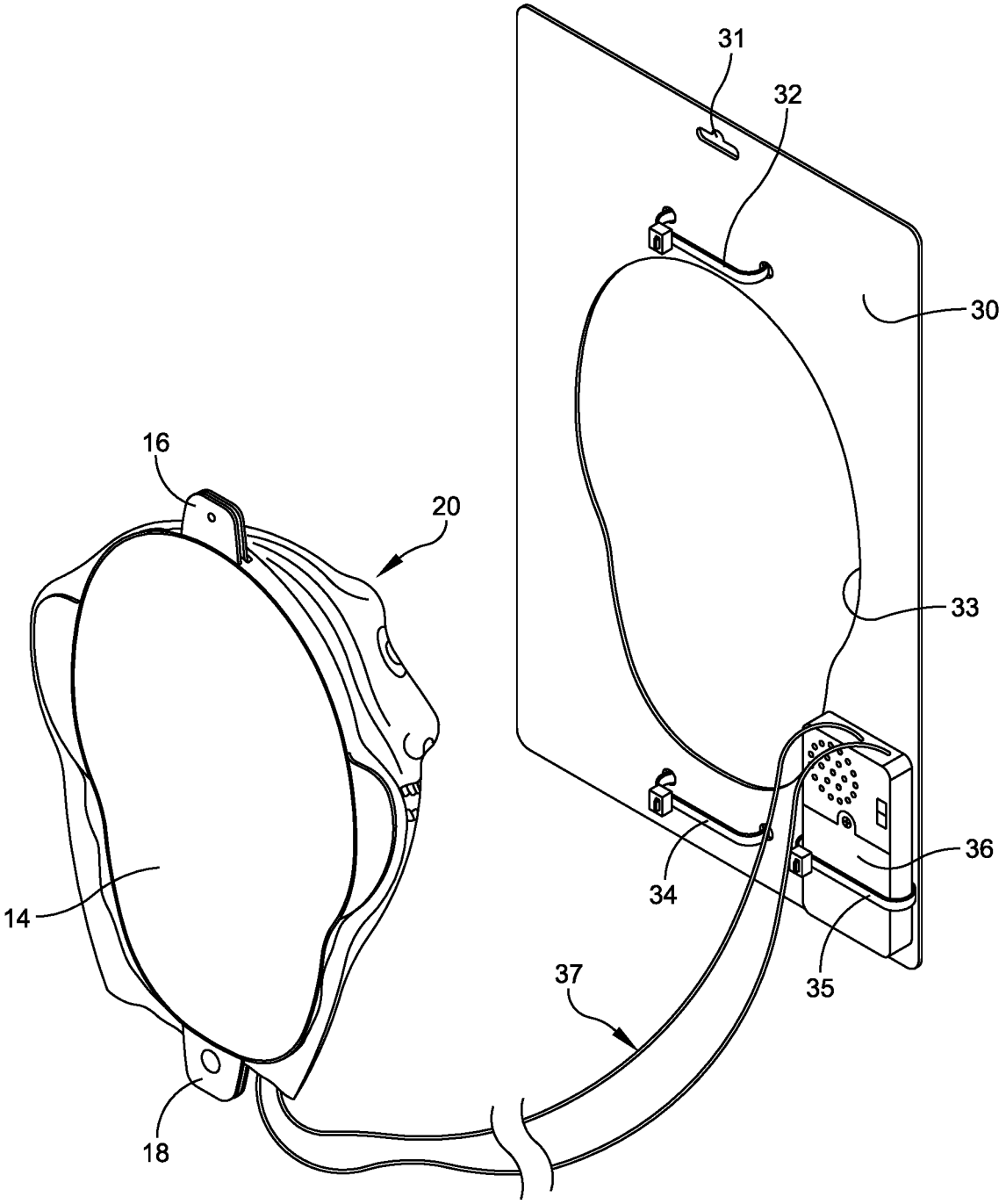
FIG. 6 is an exploded perspective view of the mask product shown in FIGS. 1-5.
Figure 7:
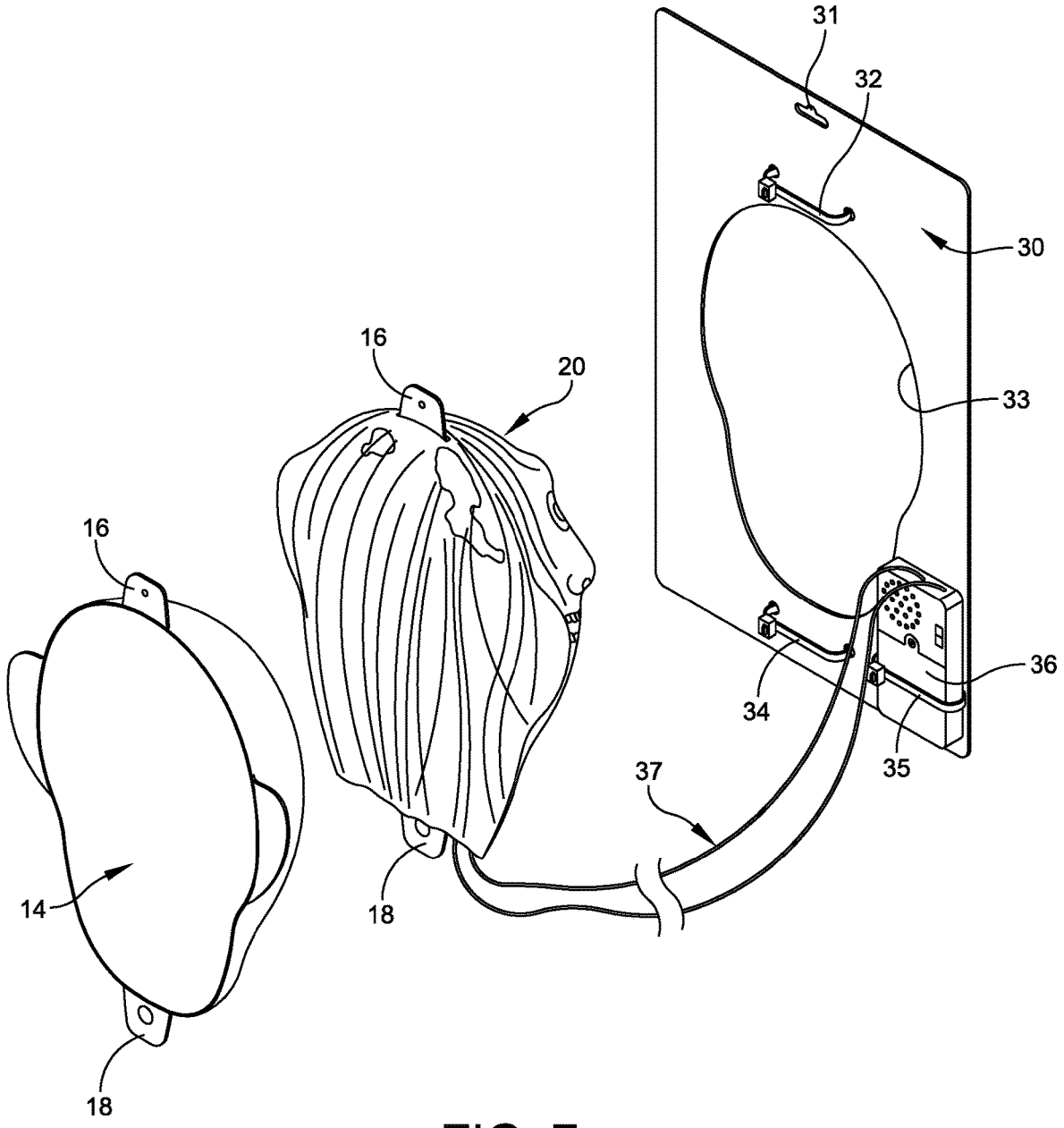
FIG. 7 is an exploded rear perspective view showing the mask separate from the rear head structure.
Figure 8:
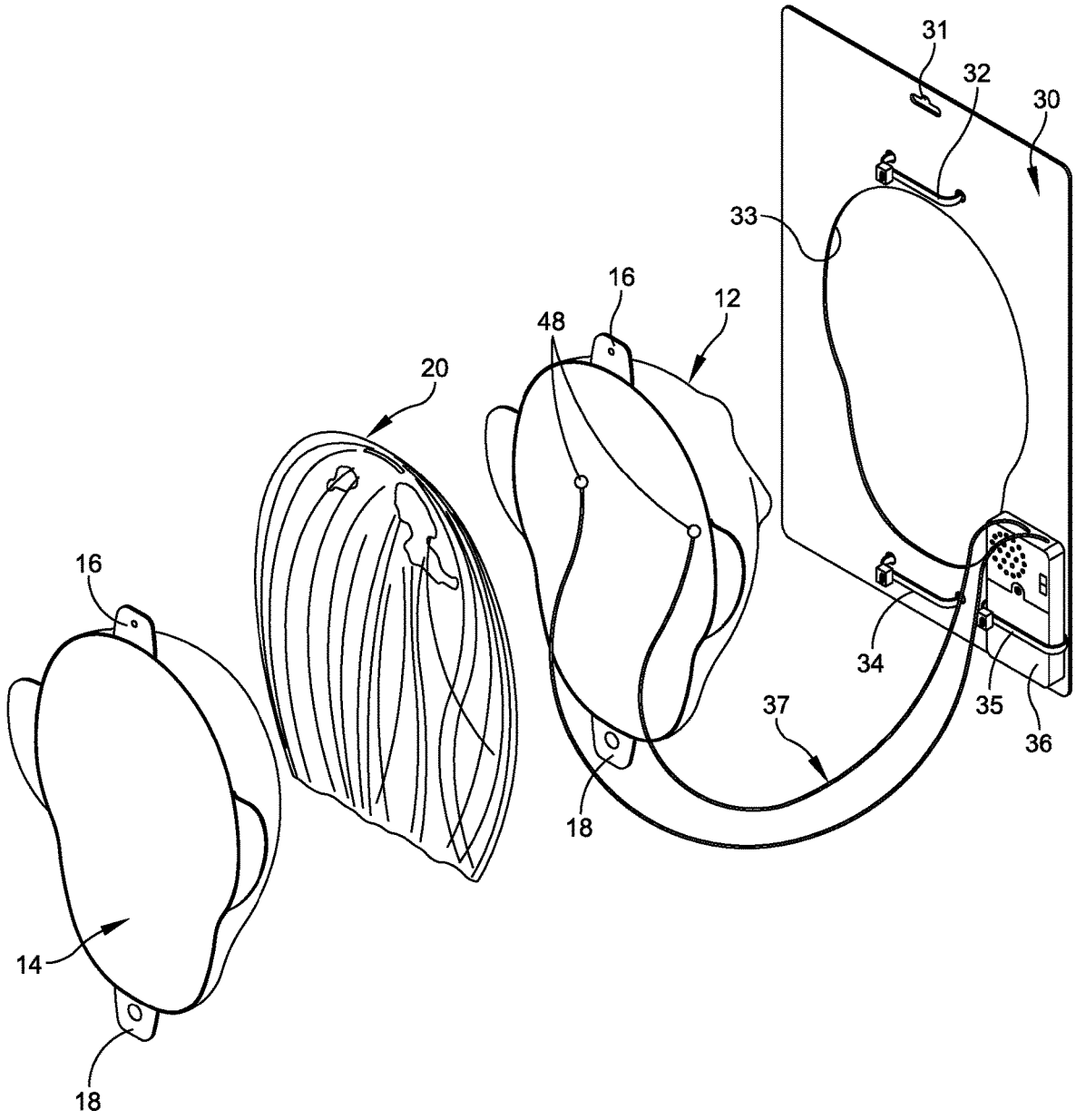
FIG. 8 is a rear exploded perspective view showing all of the components that comprise the mask product.

For the purpose of shipping and initially displaying the mask product at a merchandise location, there is provided a mounting panel 30. The mounting panel 30 may be an inexpensive cardboard or plastic rectangular panel having a slot 31 at the top of the panel. The panel can be hung from the slit or can be displayed in any other manner. The mounting panel 30 also includes several securing loops that may each be in the form of a wire tie. The rear perspective view of FIG. 2 illustrates a top loop 32, a bottom loop 34, and a third loop 35 for retaining in position the controller 36. The controller 36 is preferably battery operated and includes a switch 38 such as illustrated in FIG. 9 for turning the controller 36 on and off. FIG. 2 also illustrates a speaker outlet at 45 and wiring at 37 from the controller 36. The controller 36 can include an audio tape or the like for providing some type of an audio signal associated with the mask product. For example, the audio media may be a recording of a sound track associated with the particular mask product. If the mask product is a scary face then the audio track may be a scary recording. The wiring 37, such as illustrated in FIGS. 6-8, can connect to LEDs 48. In that regard refer to the rear perspective view of FIG. 8 showing the wiring 37 connecting to these LEDs 48. The combination of the audio statement or recording and the control of the LEDS provides a certain effect associated with the nature of the mask 20.

Figure 4A:
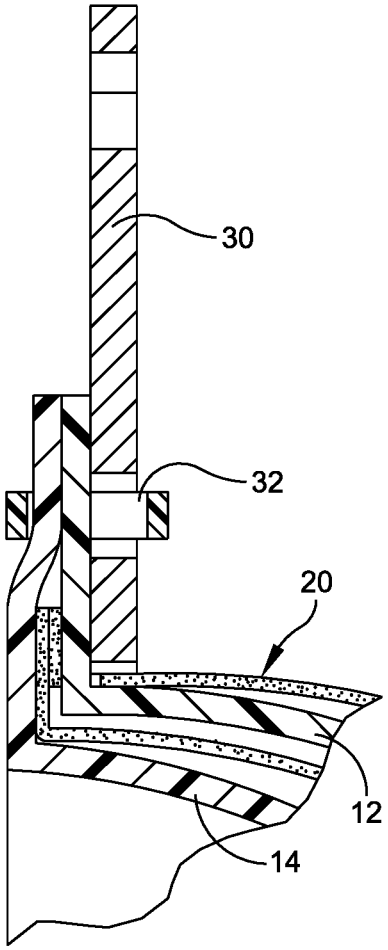
FIG. 4A is an enlarged fragmentary cross-sectional view at the area at the top of the mounting structure.
Figure 5:
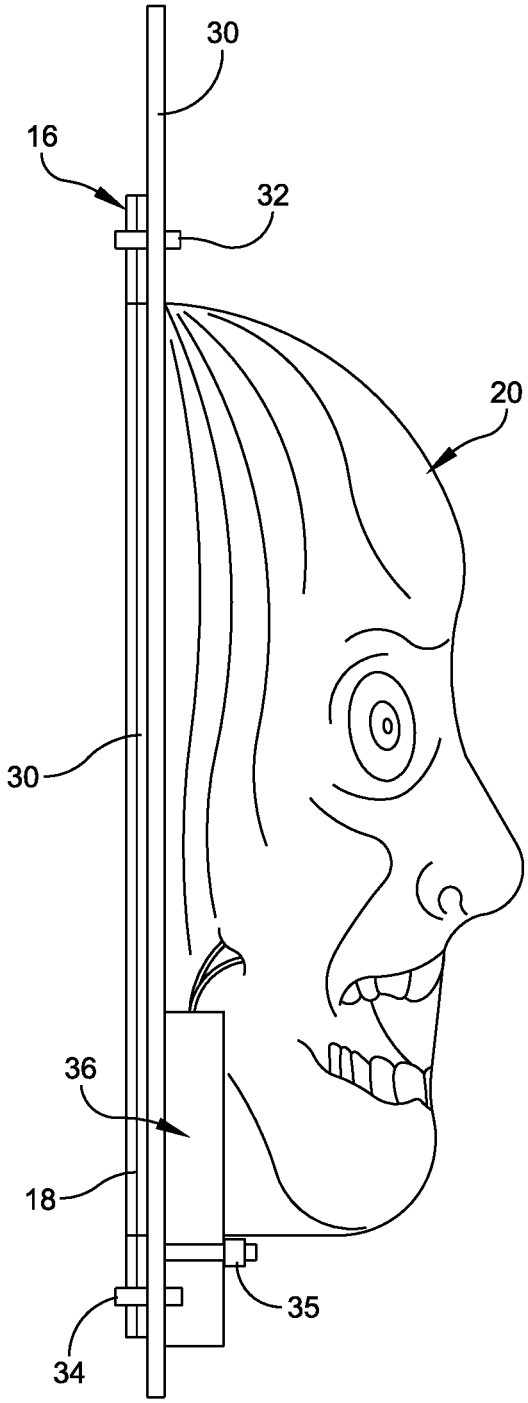
FIG. 5 is a side elevation view with the front and rear head structures nested so as to illustrate a minimum size footprint.

Each of the head structures 12 and 14 includes an integral top tab 16 and an integral bottom tab 18. These tabs are positioned adjacent to each other. In the nested position of FIGS. 4 and 4A, the tabs 16, are secured by the loop 32, and in the full head position of FIG. 11, the tabs 18 are secured by the loop 34. As illustrated in the rear perspective view of FIG. 2, the tabs 16 are held in place and adjacent or touching by the securing loop 32. Similarly, the bottom tabs 18 of the respective head structures 12 and 14 are secured by means of the bottom loop 34. In this regard refer also to the side elevation view of FIG. 5 that shows the loops 32, 34 and 35, the tabs 16 and 18, and the position of the controller 36 that is secured by the loop 35.

Reference is now made to a series of rear exploded perspective views shown in FIGS. 6-8. FIG. 8, in particular, illustrates all of these components including the controller 36, wiring 37 and LED light sources 48. FIG. 8 also illustrates the rear head structure 14 that can be nested within the front head structure as illustrated in the cross-sectional view of FIG. 4. By providing this nesting, the volumetric footprint of the mask product is minimized which is advantageous for shipping purposes. At the same time, this arrangement using the mounting panel 30, also provides a ready way for the initial display of the product such as at a merchandising site where the mask product is initially offered for sale. In this position, illustrated in FIG. 4, it is noted that the base side 20A of the mask is disposed over the front head structure 12 while the rear side 20B of the mask is disposed between the front and rear head structures 12, 14. Alternatively, the rear portion of the mask could also be positioned over the rear head structure 14.

Figure 11A:
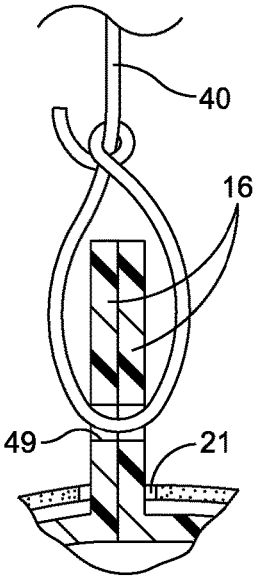
FIG. 11A is an enlarged fragmentary view from FIG. 11.

Once the product illustrated in FIG. 1 has been purchased, then instructions are provided to the purchaser so that the head structures can then be employed in a full head structure 10 such as illustrated in FIG. 11. In that position the pliable mask 20 is thus positioned over the entire full head structure. The tabs 16 and 18 may be provided with some type of a snap interlock. The tabs 16 are also provided with a slot 49 (see FIG. 11A) for receiving the cord 40. This is for the process of suspending the mask from an overhead location. The bottom tabs 18 also preferably are provided with some type of an interlock arrangement such as a tab or post and recess arrangement. This could be a snap fit. These front and rear head structures are also maintained together once the mask 20 is disposed over the head structures as illustrated in the cross-sectional view of FIG. 11.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A mask product that is comprised of a mask having facial characteristics, and a two piece head structure that is comprised of a front head structure and a rear head structure, said mask product having a packaging and shipping state in which the mask is disposed over at least the front head structure, and the rear head structure is reversed in position from a completed hollow full head structure and nested into the front head structure so as to minimize the footprint of the mask product, and a display state in which the front head structure engages with the rear head structure to form the completed hollow full head structure, the mask being disposed over the completed hollow full head structure.

2. The mask product of claim 1 including a mounting panel for the mask product, said mounting panel having a cutout having a contour matching that of the mask product and for receiving the nested front and rear head structures and wherein said mask product is hung for display purposes.

3. The mask product of claim 2 wherein each of the front and rear head structures has mating respective top and bottom tabs, and further including a pair of securing loops mounted on the mounting panel for holding the respective top and bottom tabs, and wherein the mask product is initially packaged over the nested head structures facing in a direction for initial display to show the consumer how the decorative mask will look.

4. The mask product of claim 3 wherein the respective top and bottom tabs each include interlocking surfaces so that the front and rear head structures are engaged with each other for packaging and shipping.

5. The mask product of claim 1 wherein the front and rear head structures have mating respective top tabs, and in the display state there is provided a hanging cord for hanging the mask product from an overhead surface.

6. The mask product of claim 5 including a controller disposed within or adjacent to the full head structure and for controlling audio and visual effects associated with the mask product.

7. The mask product of claim 6 including at least one light disposed within the head structure and controlled from the controller.

8. A mask product that is comprised of:

a mask having facial characteristics;

a two piece head structure that is comprised of a front head structure and a rear head structure;

said mask product having a packaging and shipping state, in which the mask is disposed over at least the front head structure, while the rear head structure is reversed in position and nested into the front head structure so as to minimize the footprint of the mask product;

the mask product further having a display state in which the front head structure engages with the rear head structure to form a complete full head structure, the mask being disposed over the complete full head structure;

and a mounting panel useable in the packing and shipping state including a cutout having a contour matching that of the nested front and rear head structures.

9. The mask product of claim 8 wherein said mask product is hung for display purposes.

10. The mask product of claim 8 wherein the mounting panel supports the mask product only in the packing and shipping state, and is supported in another manner in the display state.

11. The mask product of claim 8 wherein each of the front and rear head structures has mating respective top and bottom tabs, and further including a pair of securing loops mounted on the mounting panel for holding the respective top and bottom tabs, and wherein the mask product is initially packaged over the nested head structures facing in a direction for initial display to show the consumer how the decorative mask will look.

12. The mask product of claim 11 wherein the respective top and bottom tabs each include interlocking surfaces so that the front and rear head structures are engaged with each other for packaging and shipping.

13. The mask product of claim 8 wherein the mask is a pliable fabric mask that, in the display state, is disposed over substantially the entire full head structure.

14. The mask product of claim 8 including a controller disposed within or adjacent to the full head structure and for controlling audio and visual effects associated with the mask product, and including at least one light disposed within the head structure and controlled from the controller.

15. The mask product of claim 8 wherein the mask includes a continuous front side and rear side and having the front side of the mask is disposed over the front head structure while the rear side of the mask is disposed between the front and rear head structures.

16. The mask product of claim 11 including fasteners at respective sides of the mounting panel contour for securing the mask with the front and rear head structures.

17. The mask product of claim 8 wherein the mask includes a continuous front side and rear side and having the front side of the mask is disposed over the front head structure while the rear side of the mask is disposed over the rear head structures.

18. A mask product that is comprised of:

a mask having facial characteristics;

a two piece head structure that is comprised of a front head structure and a rear head structure;

said mask product having a first observation state in which the mask is disposed over at least the front head structure, while the rear head structure is reversed in position and nested into the front head structure so as to minimize the footprint of the mask product;

the mask product further having a second observation state in which the front head structure engages with the rear head structure to form a completed hollow head structure, the mask being disposed over the completed hollow head structure;

and a mounting panel useable in the packing and shipping state including a cutout having a contour matching that of the nested front and rear head structures.

19. A method of packaging and set-up of a mask product that is in the form of a fabric mask that is constructed and arranged, once assembled, for engagement over a two-piece head structure, said head structure comprised of an open front head structure and an open rear head structure, for the purpose of initially shipping the mask product providing a packaging and shipping state, disposing the fabric mask over at least the front head structure and nesting the rear head structure, in a reversed position from a completed hollow full head structure, into the front head structure so as to minimize the square inch footprint of the mask product, and providing a display state in which the front head structure engages with the rear head structure to form the completed hollow full head structure, the mask being disposed over the completed hollow full head structure.

20. The method of claim 19 including providing a mounting panel for the mask product, said mounting panel having a cutout having a contour matching that of the mask product and for receiving the nested front and rear head structures.

21. The method of claim 20 including providing each of the front and rear head structures with mating respective top and bottom tabs, and further including a pair of securing loops mounted on the mounting panel for holding the respective top and bottom tabs.

22. The method of claim 21 including providing interlocking surfaces on the respective top and bottom tabs so that the front and rear head structures are engaged with each other for packaging and shipping.

23. The method of claim 19 wherein the front and rear head structures have mating respective top tabs, and the set-up step further includes providing a hanging cord for hanging the mask product from an overhead surface.

24. A method of transitioning a mask product that is comprised of a two piece head structure that includes an open front head structure, an open rear head structure and a pliable fabric mask, from a packaging and shipping state to a display state, comprising the steps of establishing, in the packaging and shipping state, a nested mask product in which the fabric mask is disposed over at least the front head structure and the rear head structure, in a reversed position from a completed hollow full head structure, is nested into the front head structure so as to minimize the square inch footprint of the mask product, and in the display state, the front and rear head structures are assembled into the completed hollow full head structure, and disposing the pliable fabric mask over the completed hollow full head structure for the display of the mask product.

25. The method of claim 24 including providing a mounting panel for the mask product, said mounting panel having a cutout having a contour matching that of the mask product and for receiving the nested front and rear head structures.

26. The method of claim 25 including providing each of the front and rear head structures with mating respective top and bottom tabs, and further including a pair of securing loops mounted on the mounting panel for holding the respective top and bottom tabs.

27. The method of claim 26 including providing interlocking surfaces on the respective top and bottom tabs so that the front and rear head structures are engaged with each other for packaging and shipping.

28. The method of claim 24 including providing a controller disposed within or adjacent to the full head structure and for controlling audio and visual effects associated with the mask product and including at least one light disposed within the head structure and controlled from the controller.

29. The method of claim 28 wherein the front and rear head structures have mating respective top tabs, and the display step further includes providing a hanging cord for hanging the mask product from an overhead surface.

* * * * *